US006277298B1

(12) United States Patent
Borduz et al.

(10) Patent No.: US 6,277,298 B1
(45) Date of Patent: Aug. 21, 2001

(54) FERROFLUID COMPOSITION AND PROCESS

(76) Inventors: Lucian Borduz, 41 Bell Cover Rd., Northwood, NH (US) 03261; Shiro Tsuda, 906-17 Nishiashiarai, Asahi-shi, Chiba 289-2515 (JP); Yasutake Hirota, 265 Village Circle Way, #13, Manchester, NH (US) 03102

( * ) Notice: Subject to any disclaimer, the term of this patent is extended or adjusted under 35 U.S.C. 154(b) by 0 days.

(21) Appl. No.: 09/429,189

(22) Filed: Oct. 28, 1999

(51) Int. Cl.[7] ..... H01F 1/28
(52) U.S. Cl. ..... 252/62.52; 252/62.54
(58) Field of Search ..... 252/62.52, 62.54, 252/62.51 R

(56) References Cited

U.S. PATENT DOCUMENTS

| | | | |
|---|---|---|---|
| 4,356,098 | 10/1982 | Chagnon | 252/62.51 R |
| 4,956,113 | 9/1990 | Kanno et al. | 252/62.52 |
| 5,676,877 | 10/1997 | Borduz et al. | 252/62.52 |
| 5,851,416 | 12/1998 | Raj et al. | 252/62.52 |

FOREIGN PATENT DOCUMENTS

| | | |
|---|---|---|
| 58-063795A | 4/1983 | (JP) . |
| 61-225806A | 10/1986 | (JP) . |
| 63-175401A | 7/1988 | (JP) . |
| 63-239904A | 10/1988 | (JP) . |
| 04108898A | 4/1992 | (JP) . |
| 09017626A | 1/1997 | (JP) . |

*Primary Examiner*—C. Melissa Koslow
(74) *Attorney, Agent, or Firm*—Robert R. Deleault, Esq.; Mesmer & Deleault, PLLC

(57) ABSTRACT

The invention relates to a composition and process for producing a chemically stable magnetic fluid comprising a plurality of magnetic particles covered first with a small molecular weight surface modifier, which is a nondispersant and acts as a surfactant-accepting layer, and then with at least one surfactant. The surface modifier/surfactant coated magnetic particles are then suspended in a silicone oil-based, hydrocarbon oil-based or an ester oil-based carrier liquid.

44 Claims, 2 Drawing Sheets

FERROFLUID COMPOSITION AND PROCESS

BACKGROUND OF THE INVENTION

1. Field of the Invention

The present invention relates to magnetic fluids and a process for preparing the same. Particularly, the present invention relates to magnetic fluids using a silane-based surface modifier, which is a nondispersant, as a surfactant-accepting layer on the magnetic particles before applying a surfactant. More particularly, the present invention relates to magnetic fluids using a silane-based surface modifier, which is a nondispersant, as a surfactant-accepting layer on the magnetic particles which improves chemical stability for silicone-based, hydrocarbon-based and ester-based magnetic fluids. Yet more particularly, the present invention relates to magnetic fluids using a silane-based surface modifier which allows the use of surfactants that were not previously useable as first surfactants in oil-based magnetic fluids due to their chemical nature. Yet even more particularly, the present invention relates to a process for making stable magnetic fluids having a silane-based surface modifier, which is a nondispersant, as a surfactant-accepting layer.

2. Description of the Prior Art

Magnetic fluids, sometimes referred to as "ferrofluids" or magnetic colloids, are colloidal dispersions or suspensions of finely divided magnetic or magnetizable particles ranging in size between thirty and one hundred fifty angstroms and dispersed in a carrier liquid. One of the important characteristics of magnetic fluids is their ability to be positioned and held in space by a magnetic field without the need for a container. This unique property of magnetic fluids has led to their use for a variety of applications. One such use is their use as liquid seals with low drag torque where the seals do not generate particles during operation as do conventional seals. These liquid seals are widely used in computer disc drives as exclusion seals to prevent the passage of airborne particles or gases from one side of the seal to the other. In the environmental area, environmental seals are used to prevent fugitive emissions, that is emissions of solids, liquids or gases into the atmosphere, that are harmful or potentially harmful.

Other uses of magnetic fluids are as heat transfer fluids between the voice coils and the magnets of audio speakers, as damping fluids in damping applications and as bearing lubricants in hydrodynamic bearing applications. Yet another is their use as pressure seals in devices having multiple liquid seals or stages such as a vacuum rotary feedthrough seal. Typically, this type of seal is intended to maintain a pressure differential from one side of the seal to the other while permitting a rotating shaft to project into an environment in which a pressure differential exists.

The magnetic particles are generally fine particles of ferrite prepared by pulverization, precipitation, vapor deposition or other similar means. From the viewpoint of purity, particle size control and productivity, precipitation is usually the preferred means for preparing the ferrite particles. The majority of industrial applications using magnetic fluids incorporate iron oxides as magnetic particles. The most suitable iron oxides for magnetic fluid applications are ferrites such as magnetite or γ-ferric oxide, which is called maghemite. Ferrites and ferric oxides offer a number of physical and chemical properties to the magnetic fluid, the most important of these being saturation magnetization, viscosity, magnetic stability, and chemical stability of the whole system. To remain in suspension, the ferrite particles require a surfactant coating, also known as a dispersant to those skilled in the art, in order to prevent the particles from coagulating or agglomerating.

Fatty acids, such as oleic acid, have been used as dispersing agents to stabilize magnetic particle suspensions in some low molecular-weight non-polar hydrocarbon liquids. These low molecular-weight non-polar hydrocarbon liquids are relatively volatile solvents such as kerosene, toluene and the like. Due to their relative volatility, evaporation of these volatile hydrocarbon liquids is an important drawback as it deteriorates the function of the magnetic fluid itself. Thus to be useful, a magnetic fluid must be made with a low vapor-pressure carrier liquid and not with a low-boiling point hydrocarbon liquid. However, the hydrocarbon-based ferrofluids have been limited in some applications because of a relatively large change in viscosity as a function of temperature.

The surfactants/dispersants have two major functions. The first is to assure a permanent distance between the magnetic particles to overcome the forces of attraction caused by Van der Waal forces and magnetic attraction, i.e. to prevent coagulation or agglomeration. The second is to provide a chemical composition on the outer surface of the magnetic particle that is compatible with the liquid carrier.

The saturation magnetization (G) of magnetic fluids is a function of the disperse phase volume of magnetic materials in the magnetic fluid. In magnetic fluids, the actual disperse phase volume is equal to the phase volume of magnetic particles plus the phase volume of the attached dispersant. The higher the magnetic particle content, the higher the saturation magnetization. The type of magnetic particles in the fluid also determines the saturation magnetization of the fluid. A set volume percent of metal particles in the fluid such as cobalt and iron generates a higher saturation magnetization than the same volume percent of ferrite. The ideal saturation magnetization for a magnetic fluid is determined by the application. For instance, saturation magnetization values for exclusion seals used in hard disk drives are typically lower than those values for vacuum seals used in the semiconductor industry.

Most of the magnetic fluids employed today have one to three types of surfactants arranged in one, two or three layers around the magnetic particles. The surfactants for magnetic fluids are long enough chain and a functional group at one end. The chain may also contain aromatic hydrocarbons. The functional group can be cationic, anionic or nonionic in nature. The functional group is attached to the outer layer of the magnetic particles by either chemical bonding or physical force or a combination of both. The chain or tail of the surfactant provides a permanent distance between the particles and compatibility with the liquid carrier.

Various magnetic fluids and the processes for making the same have been devised in the past. The oil-based carrier liquid is generally an organic molecule, either polar or nonpolar, of various chemical compositions such as hydrocarbon (polyalpha olefins, aromatic chain structure molecules), esters (polyol esters), silicone, or fluorinated and other exotic molecules with a molecular weight range up to about eight to nine thousand. Most processes use a low boiling-point hydrocarbon solvent to peptize the ferrite particles. To evaporate the hydrocarbon solvent from the resultant oil-based magnetic fluid in these processes, all of these processes require heat treatment of the magnetic fluid at about 70° C. and higher or at a lower temperature under reduced pressure. Because there are a number of factors that affect the physical and chemical properties of the magnetic fluids and that improvements in one property may adversely affect another property, it is difficult to predict the effect a change in the composition or the process will have on the overall usefulness of a magnetic fluid. It is known in the art that magnetic fluids in which one of the dispersants is a fatty acid, such as oleic, linoleic, linolenic, stearic or isostearic acid, are susceptible to oxidative degradation of the dispersant system. This results in gelation of the magnetic fluid.

Silicone oils have been suggested as liquid carriers in ferrofluid compositions and for use in loudspeakers. However, stable silicone oil-based ferrofluids have been difficult to synthesize in practice. Past attempts to synthesize silicone oil-based ferrofluids, utilizing such surfactants as oleic acid, have had a very limited success. With oleic-acid-type surfactants, only ferrofluids based on silicones having very low molecular weights have been prepared with undesirable high evaporation rates of the silicone. In addition, the use of other surfactants also has proven to be unsatisfactory in preparing silicone-based ferrofluids, since such silicone-based fluids have not proven to be stable in a magnetic or gravity field, either during storage or during use.

The surfactant, which keeps the ferrofluid particles dispersed, is critical in proper ferrofluid operation. Ferrofluids with multiple surfactants have been conventionally used. One such ferrofluid is described in U.S. Pat. No. 4,956,113.

U.S. Pat. No. 4,956,113 (1990, Kanno et al.) teaches a process for preparing a magnetic fluid. The magnetic fluid contains fine particles of ferrite stably dispersed in low vapor pressure base oil. The magnetic fluid is prepared by adding N-polyalkylenepolyamine-substituted alkenylsuccinimide to a suspension of fine particles of surfactant-adsorbed ferrite dispersed in a low boiling point hydrocarbon solvent. The surfactant adsorbed on the fine particles of ferrite is one of those usually used for dispersing fine particles into a hydrocarbon solvent, preferably higher fatty acid salts and sorbitan esters. The mixture is heated to remove the hydrocarbon solvent followed by the addition of low vapor pressure base oil and a specific dispersing agent. The resultant mixture is subjected to a dispersion treatment.

It is known that ferrofluids can be prepared using a wide variety of liquid carriers including hydrocarbons, such as kerosene or heptane, aromatics such as toluene, xylene or styrene, and diesters such as ethylhexyl azelate, as well as other aqueous solutions, alcohols, acetates or ethers. However, present day hydrocarbon and ester based ferrofluids have been limited in some applications because the liquid carrier generally exhibits a relatively large change in viscosity as a function of temperature. Silicone oils (polysiloxanes) can be used as liquid carriers in ferrofluid compositions. In particular, high molecular weight polydimethylsiloxane (PDMS) oils exhibit a relatively small change in viscosity and possess a wide thermal range of operation. Therefore, ferrofluids made with PDMS oils can be used in environments where hydrocarbon and ester based ferrofluids are not readily suited.

Long-term stable and concentrated silicone oil-based ferrofluids have been difficult to synthesize in practice due, in part, to the unavailability of a satisfactory surfactant system. U.S. Pat. No. 4,356,098 (1982, Chagnon) discloses a ferrofluid with a silicone oil carrier which uses a single silicone oil surfactant. However, it has been found that the single silicone oil surfactant attaches poorly to the surface of the magnetic particles. In addition, the silicone-based ferrofluid tends to polymerize and congeal in a short period of time so that it loses its original fluid properties.

U.S. Pat. No. 5,851,416 (1998, Raj et al.) discloses silicone oil-based ferrofluid comprising a colloidal dispersion of finely divided magnetic particles in a silicone oil carrier. The surfaces of the magnetic particles are modified with a first surfactant comprising a hydrocarbon having at least one polar group and a second surfactant comprising a silicone oil surfactant having at least one polar group and which is soluble in the silicone oil carrier. It is believed that a ferrofluid based on this disclosure has a poor gel time mostly because of the large hydrocarbon tail provided by the oleic acid. It is well known that a large hydrocarbon molecule cannot dissolve in a silicone and that a large hydrocarbon molecule makes the whole system unstable. It is also believed that use of a large amount of surfactant with a carrier oil having relatively high viscosity contributes to a relatively low maximum saturation magnetization and high viscosity of the product.

All of the prior art uses one, two or three surfactants to disperse the magnetic particles in a carrier liquid. There is further a limited selection for a first dispersant that is capable of being adsorbed on magnetic particles and disperse them in carrier liquid. There is also prior art that suggests the use of a low molecular weight surface modifier as an additive to a ferrofluid.

U.S. Pat. No. 5,676,877 (1997, Borduz et al.) discloses a ferrofluid composition and a process for producing a chemically stable magnetic fluid comprising finely divided magnetic particles covered with surfactants. A surface modifier is also employed, which is added after adsorption of the surfactants, to cover thoroughly the free oxidizable exterior surface of the outer layer of the particles not covered by the surfactants.

None of the prior art proposes or suggests the use of low molecular weight surface modifiers, which are nondispersants, as surface modifiers to cover the surface area of the magnetic particles prior to adsorption of larger-sized surfactants.

Therefore, what is needed is a magnetic fluid that has a low molecular weight surface modifier covering the surface area of the magnetic particles before attachment of larger-sized surfactants. What is also needed is a magnetic fluid that has a low molecular weight silane-based surface modifier covering the surface area of the magnetic particles before attachment of larger-sized surfactants. What is further needed is a magnetic fluid that has a low molecular weight alkyl alkoxy silane based surface modifier covering the surface area of the magnetic particles before attachment of larger-sized surfactants. What is yet further needed is a silicone oil-based, hydrocarbon-based or ester-based magnetic fluid that has a low molecular weight alkyl alkoxy silane based surface modifier covering the surface area of the magnetic particles, which allows the use of surfactants that were not previously useable as first surfactants or that required a complicated process to be useable as a first surfactant. Finally what is needed is a process for making a silicone oil-based, hydrocarbon oil-based and ester oil-based magnetic fluid that has increased chemical stability.

SUMMARY OF THE INVENTION

A magnetic fluid has to exhibit stability in two areas in order to be used in current industrial applications. The first is to have magnetic stability under a very high magnetic field gradient. The magnetic particles tend to agglomerate and aggregate under high magnetic field gradients and separate out from the rest of the colloid. The second is to have chemical stability relating to oxidation of the surfactant and the organic oil carrier. All the organic oils undergo a slow of rapid oxidation process over the course of time. This results in an increased viscosity of the oil to the point where the oil becomes a gel or solid. The process is accelerated in high temperature applications of magnetic fluid.

It is an object of the present invention to provide a magnetic fluid that has a low molecular weight surface modifier covering the surface area of the magnetic particles before attachment of larger-sized surfactants, and that has increased chemical stability. It is a further object of the present invention to provide a magnetic fluid that has a low molecular weight silane-based surface modifier covering the surface area of the magnetic particles before attachment of larger-sized surfactants, and that has increased chemical stability. It is still a further object of the present invention to provide a magnetic fluid that has a low molecular weight alkyl alkoxy silane based surface modifier covering the surface area of the magnetic particles before attachment of larger-sized surfactants, and that has increased chemical stability. It is yet a further object of the present invention to provide a silicone oil-bssed, hydrocarbon oil-based or ester oil-based magnetic fluid that has a low molecular weight alkyl alkoxy silane based surface modifier covering the surface area of the magnetic particles, which allows the use of surfactants that were not previously useable as first surfactants to connect direct to the outer layers of the magnetic particles, or surfactants that required a complicated process to be useable as first surfactants, and that has increased chemical stability. A further object of the present invention is to provide a process for making a silicone oil-based, a hydrocarbon oil-based and an ester oil-based magnetic fluid that has increased chemical stability.

The present invention achieves these and other objectives by providing a magnetic fluid and a process for making a magnetic fluid where the magnetic fluid's composition includes the use of a silane-based surface modifier, which is a nondispersant, to broaden the range of useable surfactants in silicone oil-based, hydrocarbon oil-based and ester oil-based ferrofluids and to enhance the ferrofluids' chemical stability.

The present invention provides for a magnetic fluid composed of magnetic particles coated with a small molecular weight silane-based surface modifier, which is adsorbed on the outer surface of the magnetic particles. At least one surfactant is then adsorbed or attached to the surface modifier-coated particles. The particles are then suspended in a low vapor pressure carrier oil. The magnetic fluid of the present invention is made up of four components, namely an oil carrier liquid, a small molecular weight surface modifier (preferably an alkyl alkoxy silane), one or more of an organic surfactant dispersant, and fine magnetic particles. It is known that silicone oil and hydrocarbon oil are adverse components in a ferrofluid mixture, that is silicone oil is not miscible (soluble) towards hydrocarbon oil. The silicone oil and hydrocarbon oil components of the ferrofluid will separate and become an unstable fluid. It is important that the surface modifier be small so as not to interfere with the surfactant. Generally, the silane-based surface modifier must have a very small tail portion, such that the surface modifier is not capable of being used as a solo dispersant in low vapor pressure carrier liquids.

This is important because surfactants have particular properties that make them suitable as surfactants and thus are deemed to have strong individuality. However, the individuality of the surface modifier is not welcomed in our case because a large hydrocarbon tail will be unsuitable particularly in silicone oil. For the present invention, it is important that the surfactants have strong individuality but that the low molecular weight surface modifier has little individuality. Individuality is defined as the ability of the compound to influence and to contribute to the colloidal stability and other properties of the ferrofluid. Preferably, the surface modifier should have little or no individuality so that the characteristics of the ferrofluid are determined primarily or entirely by the surfactant(s). This property of the surface modifier also allows it to change the outer layer of the magnetic particles such that it allows other surfactants which could not be used previously as first surfactants to adsorb on or near the surface modifier, which itself is adsorbed directly onto the magnetic particles. It is the inventors' belief that the surfactant adsorbs on or near the silicon-oxygen portion of the surface modifier as demonstrated in FIG. 1.

The surface modifier used by the present invention consists of one to three similar functional groups ($R^1$) at one end of the molecule forming a very short tail ($R^2$). The surface modifier can be represented by the formula $$R_{4-n}{}^{1}SiR_{n}{}^{2}$$

where preferably R' denotes one to three similar functional groups where each group is an alkyl radical having one to eight carbon atoms, preferably one to six carbon atoms, more preferably one to four carbon atoms, $R^2$ denotes a hydrolyzable radical chosen from the group consisting of alkoxides of one to three carbon atoms and chlorides, and n is 1, 2 or 3 on average. In particular, isobutyltrimethoxysilane has been found to be a particularly useful surface modifier. In this particular surface modifier, $R^1$ denotes an isobutyl radical, $R^2$ denotes a methoxy radical and n is three.

The surface modifier allows the use of various surfactants, which, depending on the type of surfactant used, allow the magnetic particles to be dispersed in either silicone oil-based, hydrocarbon oil-based or ester oil-based carrier liquids. The surface modifier also allows the use of various surfactants that previously could not be used as a first surfactant on magnetic particles without the use of a less desirable first surfactant such as fatty acids.

Generally, the process for preparing the present invention is as follows. The magnetic particles are precipitated in a first solvent preferably an aqueous solution forming a magnetic particle slurry. The slurry is heated to a predetermined temperature and a predetermined quantity of small molecular weight surface modifier is added. The slurry is then either (1) subjected to high speed mixing to precipitate the particles, or (2) subjected to high speed mixing and peptization with a predetermined quantity of surfactant in a low boiling-point hydrocarbon or silicone solvent.

Under the precipitation method (1), the water is decanted and the magnetic particles coated with the small molecular weight surface modifier are washed several times with water. The magnetic particles are then suspended in a low boiling-point hydrocarbon or silicone solvent temporarily.

The low boiling-point hydrocarbon or silicone solvent used under both methods (1) and (2) includes aliphatic, alicyclic and aromatic hydrocarbon or silicone solvents having boiling points of about 60° C. to about 200° C. For example, at least one of hexane, heptane, octane, isooctane, decane, cyclohexane, toluene, xylene, mesitylene, ethylbenzene, petroleum ether, petroleum benzene, naphtha, ligroin, low molecular weight polydimethylsiloxane (PDMS) solvent, etc. can be used. Heptane is the low boiling-point hydrocarbon solvent of choice for preparing the solvent-based magnetic fluid of the present invention.

Under method (1), the fluid mix is placed on a magnet for approximately 10 minutes. The solvent is decanted and the remaining particles are suspended in more of the low boiling-point hydrocarbon solvent forming another slurry. The slurry is heated to a predetermined temperature, preferably 85° C.±5° C. A predetermined amount of surfactant in a compatible low boiling-point hydrocarbon solvent is heated up to about 85° C. and the surfactant/hydrocarbon solvent mixture is added to the slurry. The slurry/surfactant mix is stirred for a short period of time and then allowed to cool.

Under method (2), a predetermined amount of surfactant is added to a predetermined amount of low boiling-point hydrocarbon or silicone solvent and heated to a predetermined temperature. The surfactant mixture is then added to the surface-modifier coated particles mixture, stirred for about 5 minutes and allowed to cool to room temperature. The surfactant used under both methods, is a surfactant chosen from the class of surfactants having a molecular weight of at least 150 and consisting of cationic surfactants, anion surfactants and nonionic surfactants.

After cool down under both method (1) and (2), the fluid is put on a magnet for about 30 minutes. The top portion of the fluid, which is the solvent-based ferrofluid, is placed into a separate container such as a beaker. A certain amount of carrier oil is added to the solvent-based ferrofluid and the solvent is then removed, preferably by evaporation at elevated temperature. Under method (2) only, a certain amount of surfactant is also added when the carrier oil is added to the solvent-based ferrofluid.

The amount of carrier oil added is such that it is in the range of about 35% to about 75% of the volume of the final ferrofluid, depending on the preferred saturation magnetization of the final ferrofluid. A sufficient amount of carrier oil is then added to adjust the saturation magnetization of the final ferrofluid to the preferred value. The preferred value of the saturation magnetization is dependent on the intended application.

Although the fine magnetic particles of ferrite may be prepared by pulverization, precipitation, vapor deposition or other similar means, the present invention uses precipitation as the preferred method for reasons of purity, particle size control and productivity. Suitable magnetic particles for use in the present invention include ferrites such as magnetite and MnZn-based ferrites, gamma iron oxide, chromium dioxide, and various metallic alloys. Preferably, the magnetic particles are magnetite ($Fe_3O_4$) and gamma iron oxide ($Fe_2O_3$). More preferably, the magnetic particles are magnetite. The precipitation of magnetic particles is done by rapid neutralization of an aqueous solution containing iron ions by alkaline solution such as sodium hydroxide, potassium hydroxide and ammonium hydroxide that results in a suspension of fine magnetic particles. Those skilled in the art are familiar with procedures for making suitable magnetic particles.

Magnetic particles in the final magnetic fluid may have an average magnetic particle diameter from about 30 Å to about 150 Å. The preferred average magnetic particle diameter for the present invention is from about 90 Å to about 110 Å. The appropriate particle size may be readily determined based upon the intended application of the magnetic fluid. For instance, the preferred average magnetic particle diameter for use in a seal application is from about 90 Å to about 100 Å and, for an audio application, it is from about 90 Å to about 110 Å. The concentration of magnetic particles employed in the present invention is also dependent upon the intended use of the magnetic fluid and the optimal amount can be readily determined. Preferably, the concentration of magnetic particles is from about 1% to about 40% by volume of the magnetic fluid. More preferably, the concentration of magnetic particles is from about 1% to about 30% by volume of the magnetic fluid. For example, the preferred concentration of magnetic particles for a vacuum seal is from about 10% to 30% by volume, for a computer seal it is from about 5% to about 15% by volume, and, for an audio speaker, it is from about 2% to about 30% by volume.

DETAILED DESCRIPTION OF THE PREFERRED EMBODIMENT

Based on the prior art, it was surprising and unexpected to find that stable magnetic colloids in silicone oil-based, hydrocarbon oil-based and ester oil-based ferrofluids could be obtained when ferrite particles coated with small molecular weight surface modifiers, which are nondispersants having a relatively small number of carbon atoms in the tail portion, were used. Further, it was surprising and unexpected to find that magnetic colloids could be obtained with surfactants that could not previously be used for such ferrofluids when the ferrite particles were coated with a small molecular weight surface modifier, which is a nondispersant, prior to treatment with the surfactants.

Figure 1:
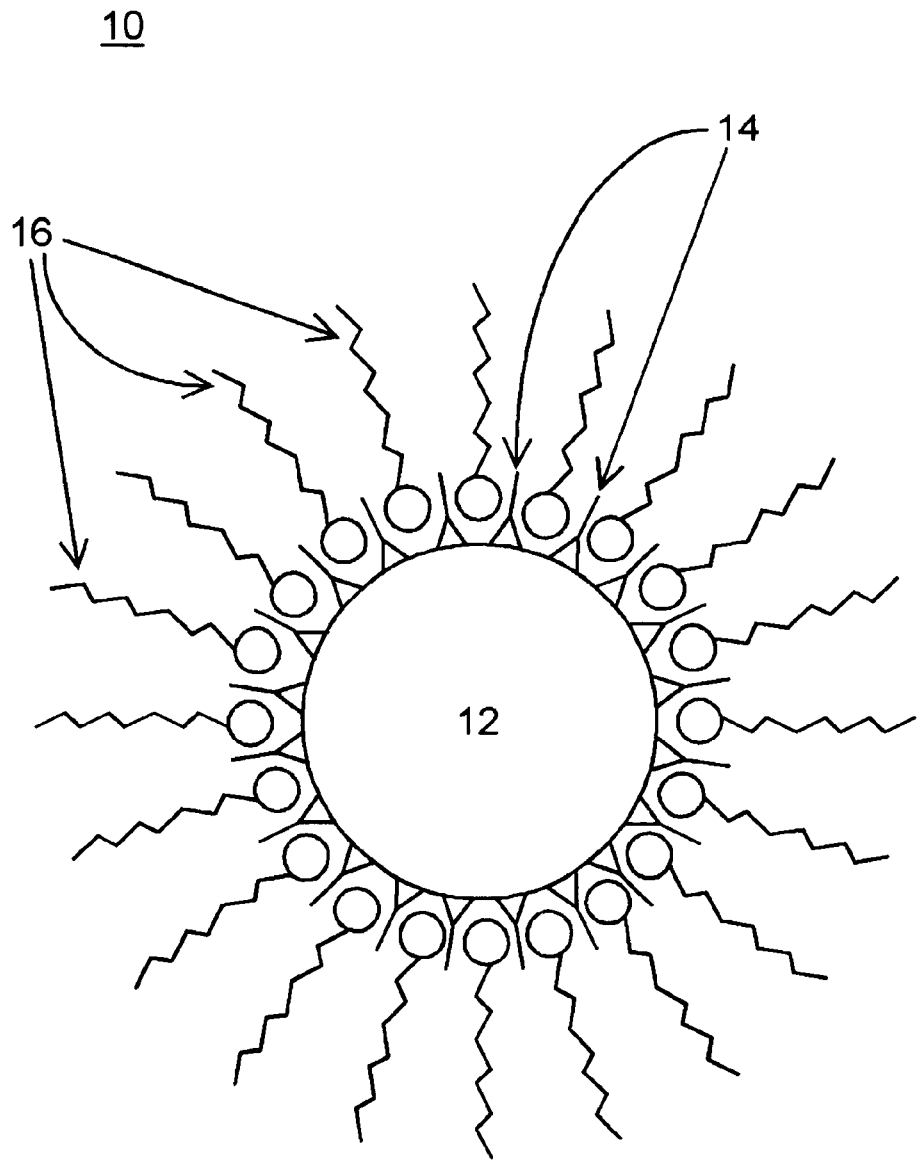
FIG. 1 shows a possible arrangement of long tail surfactants over a layer of small molecular weight surface modifier on the magnetic particles.
Figure 2:
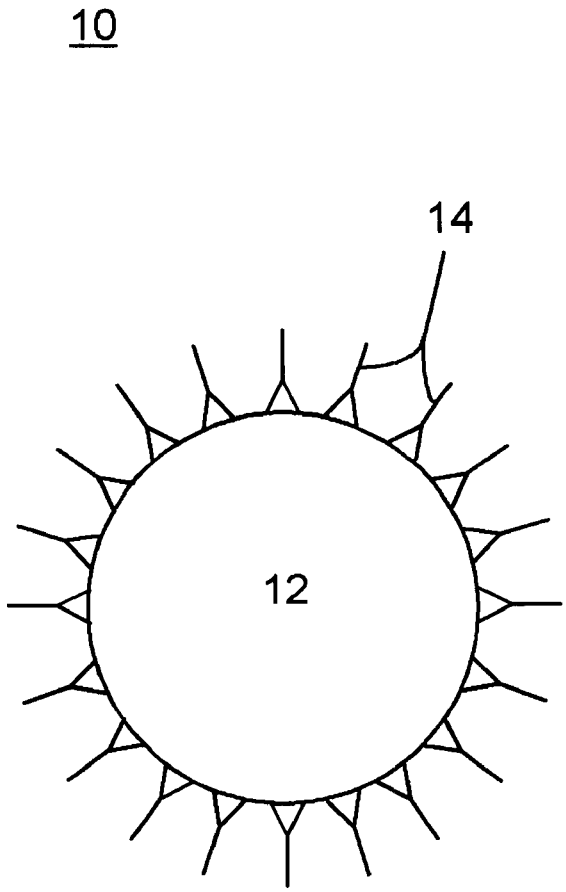
FIG. 2 shows the magnetic particles with attachment of the small molecular weight surface modifier.

The present invention uses a small molecular weight surface modifier, which is a nondispersant, to cover the magnetic particles prior to treatment with one or more surfactants. FIG. 1 is an exemplary illustration of the present invention showing a surfactant-coated magnetic particle 10. Surfactant-coated magnetic particle 10 includes a magnetic particle 12 covered by a small molecular weight surface modifier 14 that is covered by a surfactant 16. FIG. 2 shows the magnetic particle 12 covered with surface modifier 14.

The magnetic fluid of the present invention is made up of four components, namely a low vapor pressure carrier liquid, a small molecular weight surface modifier, at least one of an organic surfactant/dispersant, and fine magnetic particles. The carrier liquids are generally silicone oils, hydrocarbon oils and ester oils. For silicone oii-based ferrofluids, any polysiloxane may be used. For hydrocarbon oil-based ferrofluids, the hydrocarbon oil carrier liquid may be any carrier liquid known by those skilled in the art to be useful for magnetic fluids. The carrier liquid may be a polar carrier liquid or a nonpolar carrier liquid. The choice of carrier liquid and amount used is dependent upon the intended application of the magnetic fluid. This can be readily determined by the skilled artisan.

Nonpolar carrier liquids useful in the practice of the present invention include hydrocarbon oils, in particular poly α-olefin oils of low volatility and low viscosity. Such oils are readily available commercially. For example, SYNTHANE oils produced by Gulf Oil Company or Durasyn oils produced by Amoco Chemicals having viscosities of 2, 4, 6, 8 or 10 centistokes (cSt) at 100° C. are useful as nonpolar carrier liquids in the present invention.

Polar carrier liquids in which stable suspensions of magnetic particles may be formed include any of the ester plasticizers for polymers such as vinyl chloride resins. Such compounds are readily available from commercial sources. Suitable polar carrier liquids include polyesters of saturated hydrocarbon acids such as $C_6$–$C_{12}$ hydrocarbon acids, phthalates such as dioctyl and other dialkyl phthalates, citrate esters, and trimellitate esters such as tri(n-octyl/n-decyl) esters. Other suitable polar carriers include phthalic acid derivatives such as dialkyl and alkylbenzyl orthophthalates, phosphates such as triaryl, trialkyl or alkylaryl phosphates, and epoxy derivatives such as epoxidized soybean oil.

The preferred polar ester carrier liquid used in the present invention is a trimellitate ester. More preferably, the carrier liquid is a trimellitate triester, which are widely used as plasticizers in the wire and cable industry. The preferred trimellitate triester, for example, is available from Aristech Chemical Corporation, Pennsylvania, USA, under the trade name PX336.

Silicone oil carrier liquids are generally a liquid material of a linear polymeric structure derived from siloxane by the substitution of various organic groups to the sides of the silicon atoms, where the silicon is bonded to at least one oxygen atom in the chain. Typically such silicone oil is stable over a particular temperature range of, for example, about −50° C. to about 250° C. with very low viscosity change with temperature (very high viscosity index). The term "silicone oil" is intended to include silicone esters or other liquid silicone compounds with the above general properties. A typical formula of a silicone oil is:

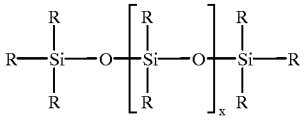

where R can be an aliphatic group such as an alkyl group, preferably a methyl, ethyl or propyl radical or alkoxy group or a phenyl group, but typically R is a phenyl group or a methyl group, or combinations thereof. In accordance with a preferred embodiment, R is a methyl group. Typical liquid silicone oils having a high viscosity index include, but are not limited to, polydimethylsiloxane, polymethylphenylsiloxane, polydipropylsiloxane, polyphenylsiloxane, and other liquid silicone oils where there is a linear silicon-oxygen backbone, and where x has a value of from about 0 to about 10,000, preferably from about 1 to about 200, and most preferably from about 10 to about 125. The oil carrier can be a mixture of carrier liquids.

The low molecular weight surface modifier used in the present invention is a silane-based surface modifier. The surface modifier used by the present invention consists of one to three similar functional groups ($R^1$) at one end of the molecule forming a very short tail of hydrocarbon atoms. The surface modifier can be represented by the formula $$R_{4-n}{}^1SiR_n{}^2$$

where $R^1$ denotes one to three similar functional groups preferably where each group is preferably an alkyl radical having one to eight carbon atoms, preferably one to six carbon atoms, more preferably one to four carbon atoms, $R^2$ denotes a hydrolyzable radical chosen from the group consisting of alkoxides of one to three carbon atoms and chlorine atoms, and n is 1, 2 or 3 on average. In particular, isobutyltrimethoxysilane has been found to be a particularly useful surface modifier. In this particular surface modifier, $R^1$ denotes an isobutyl radical, $R^2$ denotes a methoxy radical and n is three. The coupling mechanism to the free surface by the silane is thought to be either (1) that the alkoxy part of the surface modifier reacts with the proton from the inorganic hydroxyl group on the surface of the magnetic particles to form alcohol as a byproduct, or (2) that the silane surface modifier hydrolyzes with water, or (3) a combination of both, and the silicon connects to the outer layer of the magnetic particles by way of the oxygen from the hydroxyl group present on the surface modifier or on the outer layer of the magnetic particles.

During the reaction with the surface, the surface modifier becomes even smaller because a portion of the molecule, i.e. the alkoxide or chloride radicals, is eliminated as a by-product of this reaction.

For silicone oil-based ferrofluids, acceptable surfactants are those described as silicones having hydrophilic radical (s). They are composed of dimethylsiloxane molecular backbones in which some of the methyl groups are replaced by polyalkylenoxy, pyrrolidone or carboxylate groups linked through a propyl group to the silicon atom. A typical formula of a silicone surfactant is:

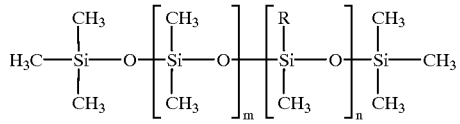

where R can be a carboxylatepropyl group or an aminoalkyl group. Typical liquid silicone surfactants include, but are not limited to, polar silicones such as (carboxylatepropyl) methylsiloxane-dimethylsiloxane copolymers and aminoethylaminopropylmethoxysiloxane-dimethylsiloxane copolymers, and other liquid silicone surfactants where there is a linear silicon-oxygen backbone.

For hydrocarbon-based and ester-based ferrofluids, surfactants such as higher fatty acids, ashless dispersants, cationic and nonionic organic compounds may be used as the surfactant.

Because of the treatment of the magnetic particles with a low molecular weight surface modifier of the present invention, the organic surfactants that could not previously be used as a first surfactant, or that required a complicated process to be used as a first surfactant, in organic solvent can now be used. Examples of such surfactants are dicocodimoniumchloride (Adrogen 462 by Witco Corporation, NY, USA), POE laurate (CPH376 by The CP Hall Company, Illinois, USA), alkyl amines (Lubrizol 890, Ircosperse 2173 and Ircosperse 2177 by Lubrizol Corporation, OH, USA), alkenyl succinic anhydride type of ashless dispersants (Paranox 105 by Exxon Chemical Company, Texas, USA), fatty acid compounds such as cetyl dimethicone copolyol+polyglyceryl isostearate, hexyl laulate (Abil WE -09 by Goldschmidt Chemical Corporation, VA, USA), polyglyceryl6 dioleate (Plurol Oleique WL 1173 by Gattefosse Corporation, NJ, USA) and polyglycerol-3-di-isostearate (Plurol Di Isostearique by Gattefosse), and polymeric ester (Troysol CD2 by Troy Chemical Corporation, NJ, USA).

Procedure for Making Magnetic Particles, Standard Size 39.4 grams of ferrous sulfate heptahydrate is dissolved in sufficient water to form a final mixture of 147 cc. To this mixture is added 64 cc of 42 Baume ferric chloride and stirred until the mixture is homogeneous creating a first mixture. A second mixture is made by adding together 90 cc of 26% ammonia solution and 55 cc of water. The first mixture is then added to the second mixture and stirred until homogeneous.

Procedure for Making Magnetic Particles, Double Size 78.8 grams of ferrous sulfate heptahydrate are dissolved in sufficient water to form a final mixture of 294 cc. To this mixture is added 128 cc of 42 Baume ferric chloride and stirred until the mixture is homogeneous creating a first mixture. A second mixture is made by adding together 180 cc of 26% ammonia solution and 110 cc of water. The first mixture is then added to the second mixture and stirred until homogeneous.

Gel Test Procedure

The magnetic fluid samples are respectively placed in a glass dish having an inside diameter of about 12.9 mm, an outside diameter of about 15.0 mm and a length of about 10.0 mm. A sufficient volume of magnetic fluid is added to each dish so that the thickness of the magnetic fluid in the glass dish is about 3 mm. The glass dishes are placed in a hole drilled aluminum plate (190 mm×315 mm×20 mm), the holes being sized such that the glass dishes fit snugly. The aluminum plate is then placed in an oven at a controlled temperature of about 150±3° C., about 170±3° C. or about 190±3° C., depending on the temperature at which a particular test is performed. The glass dishes are periodically removed from the oven, cooled to room temperature for one to two hours and examined for signs of gel formation. A small magnet is placed at the meniscus of the fluid in the dish. When the material was no longer attracted to the portion of the magnet held above the meniscus, the magnetic fluid was considered to have gelled.

EXAMPLE 1

Silicone oil-based ferrofluids of the present invention were made using the preferred surface modifier, isobutyltrimethoxysilane (available from Dow Corning Corporation, Midland, Mich., Cat. No. 1-2306) and two types of silicone surfactants, (carboxylatepropyl)methylsiloxane-dimethylsiloxane copolymers (available from Gelest, Inc., Pennsylvania, USA, Cat. No. YBD-125) and aminoethylaminopropylmethoxysiloxane-dimethylsiloxane copolymers (available from Gelest, Inc., Cat. No. ATM-1322). The carrier liquid or base oil is a polydimethyl silicone oil available from Gelest, Inc. (Cat. No. DMS T-1 2). The procedure for making the silicone oil-based ferrofluids with the preferred surface modifier follows.

It is important to note that in Step 12, a certain amount of base oil is added to the heptane-based ferrofluid. The amount of base oil to add to the heptane-based ferrofluid is typically about 35% to about 55% of the final volume of ferrofluid obtained for a 200G fluid and is typically about 55% to about 75% of the final volume of ferrofluid for a 100G fluid. The final volume of ferrofluid obtained is easily determined by those skilled in the art using the following equation:

$$V_f = \frac{M_h \times V_h}{M_f}$$

where $M_h$= saturation magnetization of the heptane-based ferrofluid $V_h$= volume of heptane-based ferrofluid $M_f$= saturation magnetization desired for final ferrofluid $V_f$= volume of final ferrofluid The saturation magnetization and the volume of the heptane-based ferrofluid determined using known techniques. Once the volume of final ferrofluid is calculated, the volume range of base oil to be added to the heptane-based ferrofluid is determined.

Step 1: The magnetic particles are manufactured according to the "Procedure for Making Magnetic Particles, double size" listed above.

Step 2: 175 cc of 26% ammonia is added to the magnetic particle slurry.

Step 3: The slurry is heated to about 55° C.±5° C.

Step 4: 70 cc of surface modifier is added to the slurry under high speed stirring to precipitate the particles.

Step 5: The water is decanted and the particles are washed with water five times.

Step 6: The particles are suspended in 250 cc of heptane.

Step 7: The heptanelparticles fluid is put on an Alnico magnet for 10 minutes.

Step 8: The solvent is decanted and 150 cc of heptane is again added to the particles.

Step 9: The heptane/particles fluid is heated to about 85° C.±5° C.

Step 10: In a separate container, 20 grams of surfactant is added to 200 cc of heptane and heated to 85° C.±5° C. then this fluid is added to the heptane/particles fluid of Step 9 and stirred for about three (3) minutes.

Step 11: The mixture is allowed to cool to room temperature and then put on the Alnico magnet for about 30 minutes.

Step 12: The heptane-based ferrofluid is decanted into another container such as a beaker. A sufficient amount of silicone oil is added such that the ferrofluids will have a saturation magnetization above 200G after evaporation of the solvent in Step 13.

Step 13: The heptane-based ferrofluid is heated until evaporation of the solvent stops and a sufficient amount of silicone oil is added to adjust the saturation magnetization of the final ferrofluid to be about 200G.

Step 14: A certain amount of the 200G fluid is used to make 150G and 100G ferrofluid. This is done by heating two separate amounts of 200G ferrofluid on a hot plate to about 100° C. and adding a sufficient amount of silicone oil to each sample to adjust the saturation magnetization of one sample to 150G and the other to 100 G.

Table 1A shows the gelation times of various silicone oil-based ferrofluids made using the surface modifier, isobutyltrimethoxysilane, with the surfactants indicated. Table 1B shows the gelation times of sample ferrofluids of similar to those of Table 1A but which have not undergone the surface modifier treatment (Steps 2–4).

TABLE 1A

| | Gel Times in Hours at Given Temperature | | |
|---|---|---|---|
| Ferrofluid with surfactant & $M_s$ | 150° C. | 170° C. | 190° C. |
| YBD-200G | 153–205 | 87–110 | 20–47 |
| YBD-150G | 318–339 | 153–205 | 87–110 |

TABLE 1A-continued

| Ferrofluid with surfactant & $M_s$ | Gel Times in Hours at Given Temperature 150° C. | 170° C. | 190° C. |
|---|---|---|---|
| YBD-100G | 612–682 | 328–355 | 153–204 |
| ATM-200G | 110–132 | 64–87 | 20–47 |
| ATM-150G | 205–226 | 110–132 | 20–47 |
| ATM-100G | 850–922 | 419–443 | 87–110 |

TABLE 1B

| Ferrofluid with surfactant & $M_s$ | No Surface Modifier: Gel Times in Hours at Given Temperature 150° C. | 170° C. |
|---|---|---|
| YBD-200G | 0–5 | 0–3 |
| YBD-150G | 0–5 | 0–3 |
| YBD-100G | 5–8 | 0–3 |
| ATM-200G | particles and oil separated | particles and oil separated |
| ATM-150G | particles and oil separated | particles and oil separated |
| ATM-100G | particles and oil separated | particles and oil separated |

EXAMPLE 2

Hydrocarbon oil-based and ester oil-based ferrofluids were made using the preferred surface modifier, isobutyltrimethoxysilane (available from Dow Corning Corporation, Midland, Mich., Cat. No. 1-2306) and three types of surfactants, Findet AD-18 available from Finetex, Inc., NJ, USA, AW398 available from Anedco, Inc., Texas, USA and Hypermer LPI available from ICI Americas, Inc., Delaware, USA. For the hydrocarbon oil-based ferrofluid, the carrier oil is poly alpha olefin having a viscosity of 4 cSt at 100C. For the ester oil-based ferrofluid, the carrier liquid is a trimellitate triester available from Aristech Chemical Corporation, Pennsylvania, USA, under the trade name PX336. The procedure for making the hydrocarbon and ester oil-based ferrofluids with the preferred surface modifier is as follows:

Step 1 to Step 8 are the same as those listed in Example 1

Step 9: A 7.5 cc sample of the heptanelparticles fluid is heated to about 85° C.±5° C.

Step 10: In a separate container, 1 gram of surfactant is added to 10 cc of heptane and heated to 85° C.±5° C. then this fluid is added to the heptane particles fluid of Step 9 and stirred for about three (3) minutes.

Step 11: The mixture is allowed to cool to room temperature and then put on the Alnico magnet for about 30 minutes.

Step 12: A sufficient amount of carrier oil is added such that the ferrofluids will have a saturation magnetization above 100G, preferably in the 100G to 200G range, after evaporation of the solvent in this Step 12. The amount of carrier oil added is calculated using the formula as described in Example 1. The heptane-based ferrofluid is heated until evaporation of the solvent stops and a sufficient amount of carrier liquid is added to adjust the saturation magnetization of the final ferrofluid to be about 100G.

Table 2 shows the gelation times of various hydrocarbon oil-based and ester oil-based ferrofluids made using the surface modifier, isobutyltrimethoxysilane, with the surfactants indicated.

TABLE 2

| Sample | Surface Modifier | Surfactant | Carrier Liquid | Gel time (hours) at 150° C. |
|---|---|---|---|---|
| 1 | No | AD-18 | PAO | Unstable |
| 2 | Yes | AD-18 | PAO | 46–70 |
| 3 | No | AW398 | PAO | 46–70 |
| 4 | Yes | AW398 | PAO | 116–130 |
| 5 | No | LPI | PAO | Unstable |
| 6 | Yes | LPI | PAO | 149–177 |
| 7 | No | AW398 | Ester | 46–70 |
| 8 | Yes | AW398 | Ester | 116–130 |
| 9 | No | LP1 | Ester | Unstable |
| 10 | Yes | LP1 | Ester | 300–325 |

PAO = Poly alpha olefin

EXAMPLE 3

Hydrocarbon oil-based ferrofluids were made using the preferred surface modifier, isobutyltrimethoxysilane (available from Dow Coming Corporation, Midland, Mich., Cat. No. 1-2306) and a lube oil additive as the first surfactant, known as Paranox 105®, containing polyalkenyl succinic anhydride nitrogen functionalized dispersant manufactured by Exxon Chemical Company, Texas, USA. It should be noted that, prior to the present invention, N-polyalkylenepolyamine-substituted alkenylsuccinimide type surfactants required a complicated process to be used as a first surfactant for making oil-based ferrofluids. Comparison tests were performed between ferrofluid samples made with the surface modifier and the surfactant and samples using oleic acid as a first surfactant and Paranox 105® as the second surfactant. The carrier oil is a poly alpha olefin known as Emery 3008 and available from Henkel Corporation, Emery Group, Ohio, USA. Additional comparison tests were performed between similar fluids but with the addition of an antioxidant called Irganox L57 available from Ciba Specialty Chemicals, New York, USA. The procedures for making the hydrocarbon oil-based ferrofluids with oleic acid and with the preferred surface modifier are as follows:

Procedure for Oleic Acid Ferrofluid

Step 1: The magnetic particles are manufactured according to the "Procedure for Making Magnetic Particles, double size" listed above.

Step 2: 8 cc of 26% ammonia is added to the magnetic particle slurry.

Step 3: 6.5 cc of oleic acid in 92.5 cc of heptane is added to the magnetic particle slurry and stirred for 5 minutes.

Step 4: 20 cc of acetone is added to the mixture of Step 3 and stirred for 3 minutes.

Step 5: The heptane based ferrofluid is siphoned off to another beaker and placed on an Alnico V magnet for 30 minutes.

Step 6: The top portion (heptane-based ferrofluid) is transferred to another beaker.

Step 7: 20.7 grams of Paranox 105 and some carrier liquid is added to the heptane based ferrofluid and the mixture is heated on a hot plate to about 160° C. and maintained for about 1 hour. The amount of carrier liquid added is calculated using the formula as described in Example 1.

Sufficient carrier liquid is used to adjust the saturation magnetization to 200G. For the sample containing antioxidant, about 2% of antioxidant to the volume of the 200G ferrofluid are added to the 200G ferrofluid.

Procedure for Surface Modifier Ferrofluid

Step 1: The magnetic particles are manufactured according to the "Procedure for Making Magnetic Particles, double size" listed above.

Step 2: 175 cc of 26% ammonia is added to the magnetic particle slurry.

Step 3: The magnetic particle slurry is heated to 55° C.±5° C.

Step 4: In a separate containerlbeaker, 20 grams of surfactant (Paranox 105) in 200 cc of heptane is heated to about 55° C.±5° C.

Step 5: 70 cc of surface modifier is added to the slurry of Step 3 under high-speed stirring to precipitate the particles.

Step 6: After about 1 minute, the particles begin to stick to each other and then the surfactant mixture of Step 4 is added to the particles of Step 5 and stirred for about 5 minutes and then allowed to cool to about room temperature.

Step 7: After cool down, the heptane based ferrofluid is siphoned off to another beaker and placed on an Alnico V magnet for 30 minutes.

Step 8: The top portion of the heptane base ferrofluid is removed to another beaker.

Step 9: 14.5 grams of Paranox 105 and some carrier liquid is added to the heptane based ferrofluid and the mixture is heated on a hot plate to about 160° C. and maintained for about 1 hour. The amount of carrier liquid added is calculated using the formula as described in Example 1. Sufficient carrier liquid is used to adjust the saturation magnetization to 200G. For the sample containing antioxidant, about 2% of the antioxidant to the volume of 200 G ferrofluid are added with the Paranox 105 to the 200G ferrofluid.

TABLE 3

| Composition | Gel Time @ 150° C. (hours) | Gel Time @ 170° C. (hours) |
|---|---|---|
| Oleic Acid + Paranox | 136–158 | 40–63 |
| Surface Modifier + Paranox | 189–211 | 63–98 |
| Oleic Acid + Paranox + 2% L57 | 211–259 | 63–98 |
| Surface Modifier + Paranox + 2% L57 | 507–533 | 136–166 |

EXAMPLE 4

Hydrocarbon oil-based and ester oil-based ferrofluids were made using the preferred surface modifier, isobutyltrimethoxysilane (available from Dow Corning Corporation, Midland, Mich., Cat. No. 1-2306) and ten surfactants which previously could not be used as the first surfactant on magnetic particles or which required a complicated process to be used as a first surfactant. The surfactants tested are Androgen 462 available from Witco Corporation, New York, USA, CPH376 available from The C. P. Hall Company, Illinois, USA, Lubrizol 890, Ircosperse 2173, and Ircosperse 2177 available from Lubrizol Corporation, Ohio, USA, Paranox 105 available from Exxon Chemical Company, Texas, USA, Abil WE09 available from Goldschmidt Chemical Corporation, Virginia, USA, Plurol Oleique WL1173 and Plurol Di Isostearique (PIS) available from Gattefosse Corporation, New Jersey, USA, and Troysol CD2 available from Troy Chemical Corporation, New Jersey, USA. For the hydrocarbon oil-based ferrofluid, the carrier oil is poly alpha olefin having a viscosity of 4 cSt at 100° C. available from Henkel Corporation, Emery Group, Ohio, USA (Cat. No. 3004). For the ester oil-based ferrofluid, the carrier oil is a trimellitate triester available from Aristech Chemical Corporation, Pennsylvania, USA, under the trade name PX336. The procedure for making the hydrocarbon oil-based and ester oil-based ferrofluids with the preferred surface modifier is as follows:

Step 1 to Step 8 are the same as those listed in Example 1.

Step 9: The heptane/particles fluid is divided into 20 samples and heated to about 85° C.±5° C.

Step 10: In a separate container, 1 gram of surfactant is added to 10 cc of heptane and heated to 85° C.±5° C. then this fluid is added to one sample of the heptane particles fluid of Step 9 and stirred for about three (3) minutes. This step is repeated for each of the remaining 19 samples such that each pair of samples will contain the same surfactant for later use in making a hydrocarbon oil-based and an ester oil-based ferrofluid.

Step 11: The mixture is allowed to cool to room temperature and then put on the Alnico magnet for about 30 minutes.

Step 12: A sufficient amount of carrier oil is added such that the ferrofluids will have a saturation magnetization above 100G after evaporation of the solvent in this Step 12. The amount of carrier oil added is calculated using the formula as described in Example 1. The heptane-based ferrofluid is heated until evaporation of the solvent stops and a sufficient amount of carrier liquid is added to adjust the saturation magnetization of the final ferrofluid to be about 100G. The carrier liquid is either Emery 3004 or PX-336.

Table 4 shows the gelation times of various hydrocarbon oil-based and ester oil-based ferrofluids made using the surface modifier, isobutyltrimethoxysilane, with the surfactants indicated.

TABLE 4

| | Gel Test in Hours at 150° C. | |
|---|---|---|
| Surfactant | Hydrocarbon Oil | Ester Oil |
| Adogen 462 | 0–22 | 445–470 |
| CPH376 | NG | 292–364 |
| Lubrizol 890 | 65–89 | 382–406 |
| Ircosperse 2173 | 136–150 | 445–470 |
| Ircosperse 2177 | 65–89 | 382–403 |
| WE-09 | 65–89 | 45–65 |
| WL 1173 | 0–22 | 22–46 |
| PIS | 46–65 | 200–220 |
| Troysol CD2 | 0–22 | 0–22 |
| Paranox 105 | 136–150 | 200–220 |

NG means that a stable colloid was not produced

EXAMPLE 5

Silicone oil-based ferrofluids of the present invention were made using other small molecular weight silane-based surface modifiers. These surface modifiers are isobutyltrimethoxysilane (Cat. No. SII6453.7 from Gelest, Inc., Pennsylvania, USA), isobutyltrimethoxysilane (Cat. No.

SII6453.5 from Gelest, Inc.), dimethyldimethoxysilane (Cat. No. KBM22 from Shin-Etsu Chemical Co., Ltd., Tokyo, Japan), dimethyldiethoxysilane (Cat. No. SID412110 from Gelest, Inc.), trimethylmethoxysilane (Cat. No. SIT8566.0 from Gelest, Inc.), n-propyltrimethoxysilane (Cat. No. SIP6918.0 from Gelest, Inc.), n-butyltrimethoxysilane (Cat. No. SIB1988.0 from Gelest, Inc.), and isobutyltrichlorosilane (Cat. No. SII6453.0 from Gelest, Inc.). The silicone surfactant is YBD125 from Gelest, Inc. The carrier liquid or base oil is a polydimethylsiloxane available from Gelest, Inc. (Cat. No. DMS T-12). The procedure for making the silicone oil-based ferrofluid with the above-listed surface modifiers are as follows:

Step 1: The magnetic particles are manufactured according to the "Procedure for Making Magnetic Particles, double size" listed above.

Step 2: Take about one-tenth of the volume of the mixture in Step 1. (About one tenth of the volume is used for each surface modifier tested.)

Step 3: 35 cc of 26% ammonia is added to the magnetic particle slurry of Step 2.

Step 4: The slurry is heated to about 55° C.±5° C.

Step 5: A specific amount of surface modifier is added to the slurry under high speed stirring for about 5 minutes to precipitate the particles. The amount of each surface modifier is given in Table 5.

Step 6: The water is decanted and the particles are washed with water five times and divided into 2 samples.

Step 7: A sufficient amount of heptane is added to each of the divided particles of Step 6 to make about 30 cc of magnetic particle slurry.

Step 8: The heptane-based fluid is placed on a large Alnico V magnet for about 10 minutes.

Step 9: The solvent is decanted and additional heptane is added to the remaining particles to form about 20 cc of slurry.

Step 10: The slurry is heated to about 85°C.±5° C.

Step 11: In a separate container/beaker, 3 grams of surfactant in about 20 cc of heptane is heated up to 85° C.±5° C.

Step 12: The heated surfactant iheptane mixture of Step 11 is added to the heated slurry of Step 10 and stirred for about 3 minutes.

Step 13: The mixture of Step 12 is allowed to cool to room temperature and then placed over the Alnico magnet for about 30 minutes.

Step 14: The top portion of the heptane-based ferrofluid is removed to another beaker. A certain amount of the carrier oil is added to the heptane-based ferrofluid. A sufficient amount of silicone oil is added such that the ferrofluids will have a saturation magnetization above 100G after evaporation of the solvent. The amount of carrier oil added is calculated using the formula as described in Example 1. The mixture is heated to evaporate the solvent. After evaporation of the solvent, some carrier oil is added to the ferrofluid to adjust the saturation magnetization of the final ferrofluid to be about 100G.

Table 5 shows the gelation times of silicone oil-based ferrofluids made using other small molecular weight surface modifiers.

TABLE 5

| Surface Modifier | Amount of Surface Modifier (cc) | Trade Name | Gel Time @ 150° C. (hours) |
|---|---|---|---|
| No surface modifier | 0.0 | — | 5–8 |
| Isobutyltrimethoxysilane | 14.0 | SII6453.7 | 150+ |
| Isobutyltriethoxysilane | 17.8 | SII6453.5 | 8–23 |
| Dimethyl dimethoxysilane | 10.2 | KBM22 | 23–27 |
| Dimethyldiethoxysilane | 12.9 | SID4121.0 | 8–23 |
| Trimethylmethoxysilane | 10.1 | SIT8566.0 | 8–23 |
| n-propyltrimethoxysilane | 12.9 | SIP6918.0 | 150+ |
| n-butyltrimethoxysilane | 14.0 | SIB1988.0 | 150+ |
| Isobutyltrichlorosilane | 12.1 | SII6453.0 | 150+ |

EXAMPLE 6

Hydrocarbon oil-based ferrofluids of the present invention were made using other small molecular weight silane-based surface modifiers. These surface modifiers are n-propyltrimethoxysilane (Cat. No. SIP6918.0 from Gelest, Inc.), n-butyltrimethoxysilane (Cat. No. SIB1988.0 from Gelest, Inc.), and isobutyltrichlorosilane (Cat. No. SII6453.0 from Gelest, Inc.). The surfactant is an ashless dispersant available under the trade name Paranox 105. The carrier oil is poly alpha olefin having a viscosity of 8 cSt at 100° C available from Henkel Corporation, Emery Group (Cat. No. 3008). The procedure for making the hydrocarbon oil-based ferrofluids with the above-listed surface modifiers are as follows:

Step 1: The magnetic particles are manufactured according to the "Procedure for Making Magnetic Particles, standard size " listed above.

Step 2: Take about one-tenth of the volume of the mixture in Step 1. (About one tenth of the volume is used for each surface modifier tested.)

Step 3: 35 cc of 26% ammonia is added to each of the divided magnetic particle slurry of Step 2.

Step 4: The slurry is heated to about 55° C.±5° C.

Step 5: A specific amount of surface modifier is added to the slurry under high speed stirring for about 5 minutes to precipitate the particles. The amount of each surface modifier is given in Table 6.

Step 6: The water is decanted and the particles are washed with water five times and divided into 2 samples.

Step 7: A sufficient amount of heptane is added to one of the divided particles of Step 6 to make about 30 cc of magnetic slurry.

Step 8: The heptane-based fluid is placed on a large Alnico V magnet for about 10 minutes.

Step 9: The solvent is decanted and additional heptane is added to the remaining particles to form about 20 cc of slurry.

Step 10: The slurry is heated to about 85° C.±5° C.

Step 11: 4 grams of surfactant in about 20 cc of heptane is heated up to 85° C.±5° C.

Step 12: The heated surfactant iheptane mixture of Step 11 is added to the heated slurry of Step 10 and stirred for about 3 minutes.

Step 13: The mixture of Step 12 is allowed to cool to room temperature and then placed over the Alnico magnet for about 30 minutes.

Step 14: The top portion of the heptane-based ferrofluid is removed to another beaker. A sufficient amount of carrier oil is added to the heptane-based ferrofluid such that the ferrofluid will have a saturation magnetization above 100G after evaporation of the solvent. The amount of carrier oil added is calculated using the formula as described in Example 1. The mixture is heated to evaporate the solvent. After evaporation of the solvent, some carrier oil (poly alpha olefin oil) is added to the ferrofluid to adjust the saturation magnetization of the final ferrofluid to be about 100G.

Table 6 shows the gelation times of hydrocarbon oil-based ferrofluids made using the other small molecular weight surface modifiers.

TABLE 6

| Surface Modifier | Amount of Surface Modifier (cc) | Trade Name | Gel Time @ 150° C. (hours) |
|---|---|---|---|
| No surface modifier | 0.0 | — | NG |
| n-propyltrimethoxysilane | 12.9 | SIP6918.0 | 150+ |
| n-butyltrimethoxysilane | 14.0 | SIB1988.0 | 150+ |
| Isobutyltrichlorosilane | 12.1 | SII6453.0 | 150+ |

NG means that a stable colloid was not produced.

What is claimed is:

1. An improved ferrofluid composition comprising:

a plurality of magnetic particles;

a silane-based surface modifier adsorbed on said plurality of magnetic particles as a surfactant-accepting layer, said surface modifier having a small enough molecular weight sufficient to be a nondispersant and having little or no individuality compared to the individuality of a surfactant;

at least one surfactant coating over said silane-based surface modifier in the outer layers of said plurality of magnetic particles; and a carrier liquid.

2. The composition of claim 1 wherein said silane-based surface modifier has a functional group of one to eight carbon atoms.

3. The composition of claim 2 wherein said silane-based surface modifier has a functional group of one to six carbon atoms.

4. The composition of claim 3 wherein said silane-based surface modifier has a functional group of one to four carbon atoms.

5. The composition of claim 1 wherein said silane-based surface modifier is represented by the formula $$R_{4-n}{}^{1}SiR_{n}{}^{2}$$

wherein $R^1$ denotes one to three similar functional groups where each group is an alkyl radical having one to eight carbon atoms, $R^2$ denotes a hydrolyzable radical of one to three atoms, and n is 1, 2 or 3.

6. The composition of claim 5 wherein said hydrolyzable radical is chosen from the group consisting of alkoxides of one to three carbon atoms.

7. The composition of claim 5 wherein said hydrolyzable radical is chloride.

8. The composition of claim 1 wherein said silane-based surface modifier is selected from the group consisting of isobutyltrimethoxysilane, isobutyltriethoxysilane, dimethyidimethoxysilane, dimethydiethoxysilane, trimethylmethoxysilane, n-propyltrimethoxysilane, n-butyltrimethoxysilane, and isobutyltrichlorosilane.

9. The composition of claim 1 wherein said surfactant is chosen from the class of surfactants consisting of cationic surfactants, anionic surfactants and nonionic surfactants and has a molecular weight of at least 150.

10. The composition of claim 1 wherein said carrier fluid is an organic molecule compatible with at least one surfactant.

11. The composition of claim 10 wherein said carrier fluid is one of a silicone-based carrier fluid, a hydrocarbon-based carrier fluid and an ester-based carrier fluid.

12. The composition of claim 1 wherein said carrier fluid is a silicone oil-based carrier fluid, a hydrocarbon oil-based carrier fluid or an ester oil-based carrier fluid.

13. The composition of claim 1 wherein said silane-based surface modifier is an alkyl alkoxy silane surface modifier or an alkyl chloro silane surface modifier.

14. The composition of claim 1 further comprising an antioxidant in said improved ferrofluid composition.

15. A magnetic fluid obtained by the process comprising:

adsorbing a silane-based surface modifier onto a plurality of magnetic particles as a surfactant-accepting layer, said surface modifier having a sufficiently small molecular weight to be a nondispersant and having little or no individuality compared to the individuality of a surfactant;

coating at least one surfactant over said silane-based surface modifier in the outer layers of said plurality of magnetic particles; and suspending said plurality of magnetic particles into a carrier liquid.

16. The magnetic fluid of claim 15 wherein said silane-based surface modifier has a functional group of one to eight carbon atoms.

17. The magnetic fluid of claim 16 wherein said silane-based surface modifier has a functional group of one to six carbon atoms.

18. The magnetic fluid of claim 17 wherein said silane-based surface modifier group of one to four carbon atoms.

19. The composition of claim 1 wherein said silane-based surface modifier is represented by the formula $$R_{4-n}{}^{1}SiR_{n}{}^{2}$$

wherein $R^1$ denotes one to three similar functional groups where each group is an alkyl radical having one to eight carbon atoms, $R^2$ denotes a hydrolyzable radical of one to three atoms, and n is 1, 2 or 3.

20. The magnetic fluid of claim 19 wherein said hydrolyzable radical is chosen from the group consiting of alkoxides of one to three carbon atoms.

21. The magnetic fluid of claim 19 wherein said hydrolyzable radical is chloride.

22. The magnetic fluid of claim 15 wherein said silane-based surface modifier is selected from the group consisting of isobutyltrimethoxysilane, isobutyltriethoxysilane, dimethyidimethoxysilane, dimethydiethoxysilane, trimethylmethoxysilane, n-propyltrimethoxysilane, n-butyltrimethoxysilane, and isobutyltrichlorosilane.

23. The magnetic fluid of claim 15 wherein said surfactant is selected from the group of surfactants consisting of cationic surfactants, anionic surfactants and nonionic surfactants and wherein said surfactant has a molecular weight of at least 150.

24. The magnetic fluid of claim 15 wherein said carrier fluid is an organic molecule compatible with at least one surfactant.

25. The magnetic fluid of claim 24 wherein said carrier fluid is a silicone oil-based carrier fluid, a hydrocarbon oil-based carrier fluid or an ester oil-based carrier fluid.

26. The magnetic fluid of claim 15 awherein said silane-based surface modifier is an alkyl alkoxy silane surface modifier or an alkyl chloro silane surface modifier.

27. The magnetic fluid of claim 15 further comprising adding an antioxidant to said magnetic fluid.

28. A method of making an improved ferrofluid composition, said method comprising:

obtaining a plurality of magnetic particles suspended in a first solvent;

adsorbing a small molecular weight silane-based surface modifier on said plurality of magnetic particles, said surface modifier having a small enough molecular weight sufficient to be a nondispersant and having little or no individuality compared to the individuality of a surfactant;

coating said plurality of said surface-modifier adsorbed particles with at least one surfactant; and suspending said plurality of coated magnetic particles in an oil-based carrier liquid.

29. The method of claim 28 wherein said step of obtaining said plurality of magnetic particles further includes heating said plurality of magnetic particles to a temperature above ambient temperature and below the boiling point of said first solvent.

30. The method of claim 29 wherein said heating is at a temperature of about 50° C to about 60° C.

31. The method of claim 28 wherein said surface modifier absorbing step further includes adding said surface modifier to said plurality of magnetic particles in said first solvent.

32. The method of claim 31 further comprising stirring said solvent at sufficiently high speed to precipitate said plurality of magnetic particles.

33. The method of claim 32 further comprising separating said first solvent from said plurality of magnetic particles and suspending said plurality of magnetic particles in a first portion of a second solvent.

34. The method of claim 33 further comprising heating said plurality of magnetic particles suspended in said first portion of said second solvent to a temperature above ambient and be low the boiling point of said second solvent.

35. The method of claim 28 wherein said surfactant-coating 'step further includes adding said at least one surfactant to a second portion of said second solvent forming a surfactant mixture and heating said surfactant mixture to a temperature above ambient temperature and below the boiling point of said second solvent.

36. The method of claim 35 further comprising combining said surfactant mixture with said plurality of magnetic particles having said surface modifier adsorbed thereon.

37. The method of claim 26 wherein said oil-based carrier liquid suspending step further includes adding a predetermined amount of said carrier liquid to said plurality of surfactant-coated magnetic particles and removing said second solvent.

38. The method of claim 37 further comprising adding a sufficient amount of said carrier liquid after removal of said second solvent to obtain a magnetic fluid having a predetermined saturation magnetization.

39. The method of claim 25 wherein said surfactant-coating step further includes adding said at least one surfactant to a second solvent forming a surfactant mixture and heating said surfactant mixture to a temperature above ambient temperature and below the boiling point of said second solvent.

40. The method of claim 39 further comprising combining said surfactant mixture with said plurality of magnetic particles having said surface modifier adsorbed thereon forming a combined mixture and stirring said combined mixture for a predetermined time.

41. The method of claim 40 further comprising placing said combined mixture over a magnet for a predetermined time.

42. The method of claim 41 further comprising removing a top liquid portion of said combined mixture, adding a predetermined amount of said carrier liquid and said surfactant to said top liquid portion and then removing said second solvent.

43. The method of claim 42 further comprising adding a sufficient amount of said carrier liquid after removal of said second solvent to obtain a magnetic fluid having a predetermined saturation magnetization.

44. The method of claim 28 further comprising adding an antioxidant to said improved ferrofluid composition.

* * * * *